US009884410B1

(12) United States Patent
Ford

(10) Patent No.: US 9,884,410 B1
(45) Date of Patent: Feb. 6, 2018

(54) SUPPLEMENT SUPPORT SYSTEM SLEEVE FOR A UNIVERSAL JOINT

(71) Applicant: Robert Ford, Canaan, NH (US)

(72) Inventor: Robert Ford, Canaan, NH (US)

( * ) Notice: Subject to any disclaimer, the term of this patent is extended or adjusted under 35 U.S.C. 154(b) by 0 days.

(21) Appl. No.: 14/481,030

(22) Filed: Sep. 9, 2014

(51) Int. Cl.
*B25B 23/00* (2006.01)
*B25B 13/06* (2006.01)

(52) U.S. Cl.
CPC ..... *B25B 23/0014* (2013.01); *B25B 13/06* (2013.01); *B25B 23/0021* (2013.01)

(58) Field of Classification Search
CPC .. B25B 23/0014; B25B 23/0021; B25B 13/06
USPC ..... 81/180.1, 184
See application file for complete search history.

(56) References Cited

U.S. PATENT DOCUMENTS 3,378,286 A * 4/1968 Gottschald ..... B60G 7/005 277/635
4,004,476 A * 1/1977 DeVrou ..... B25B 23/0021 16/431
4,530,261 A * 7/1985 Ventura ..... B25B 13/481 81/177.75
4,748,872 A * 6/1988 Brown ..... B25B 21/001 81/57.26
5,003,849 A * 4/1991 Lawrie ..... B25B 23/0014 403/223
6,813,975 B2 * 11/2004 Kozak ..... B25B 23/0021 81/177.6
6,928,902 B1 * 8/2005 Eyssallenne ..... B25B 21/00 81/57.26
7,082,864 B1 * 8/2006 Weber ..... B25B 13/06 81/180.1

* cited by examiner

*Primary Examiner* — Hadi Shakeri

(57) ABSTRACT

A supplement support system sleeve. Descriptive of the tool part know as a Universal Joint that improves managing the flex when adapting parts are heavier than the resistance of the flex of the Universal Joint. Staying on the smooth surfaces with a directional system design to flex that includes a flex Stop with a per determined adjustment location within the tool part design. Offering limited resistance to the movement to no reduction to the tool part design values or intended use other then increasing the size when installed. Made from flexible material.

3 Claims, 6 Drawing Sheets

SUPPLEMENT SUPPORT SYSTEM SLEEVE FOR A UNIVERSAL JOINT

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING, TABLE, OR A COMPUTER PROGRAM LISTING COMPACT DISC APPENDIX

"Not Applicable"

BACKGROUND

The universal joint in part of a ratchet set. Set meaning the different parts that connect to for different uses example an extension, universal joint and socket to use with a ratchet or breaker bar. As far back as I can remember the universal joint was unique as its design allowing us as in users or I in the use to reach a nut or bolt without our hands right in the area of a offset location and as well as were a wrench would not fit or fit and still have leverage to loosen or tighten. The cumbersome part of use was the flex that it needed to properly work to its design. (Floppy) More often to use two hands and not to install parts that were more assessable to being damaged, as in a sparkplug and its gap with the use of the universal joint to install the sparkplug. It was sparkplug installed by hand then the socket, universal joint and extension to ratchet to finish the install and to tighten. More over the back yard methods of tape and even pinning the pivot points to tighten up the floppiness to have a level of managing while use, restricted the tool part design. All good working avenues to achieve in managing but reduced the tools design value and tool upkeep. After reading the description those skilled in the art will understand the uniqueness that the supplement support system sleeve will do the job and the design to stay on the smooth surfaces of universal joint without restricting the pivot points. Instead having rigidness while maintaining the flex of the tool part design

BRIEF SUMMARY

A supplement support system sleeve made of flexible material with a unique directional system design that includes a flex stop system that holds the supplement support system sleeve on the most common smooth surfaces and flexing parts of the tool part know as a universal joint while staying on per application. With the universal joint most commonly used with a ratchet and its sets. Improving managing the weight of the attached parts to the universal joint while maintaining flexibility and the capacity of the tool part design other then increasing the size when installed.

BRIEF DESCRIPTION DRAWINGS

Figure 1:
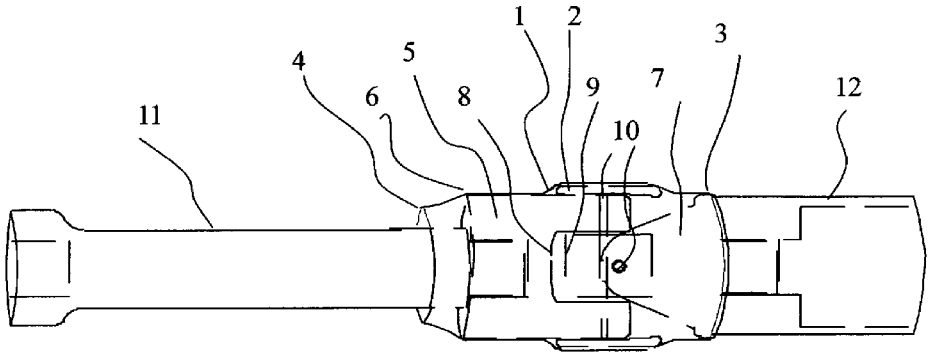
Figure 2:
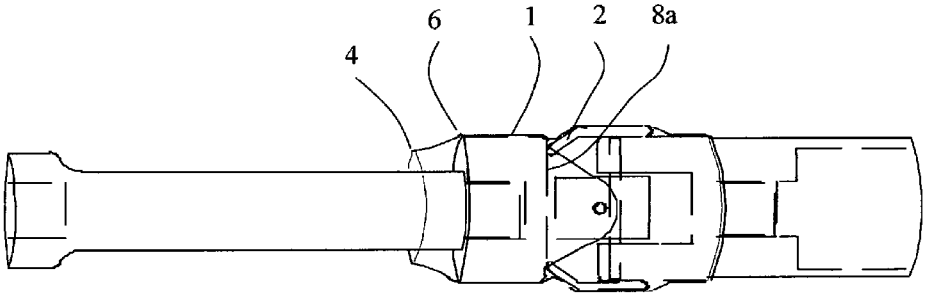
Figure 3:
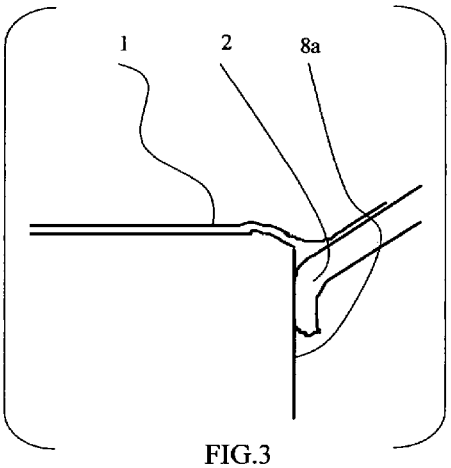
Figure 4:
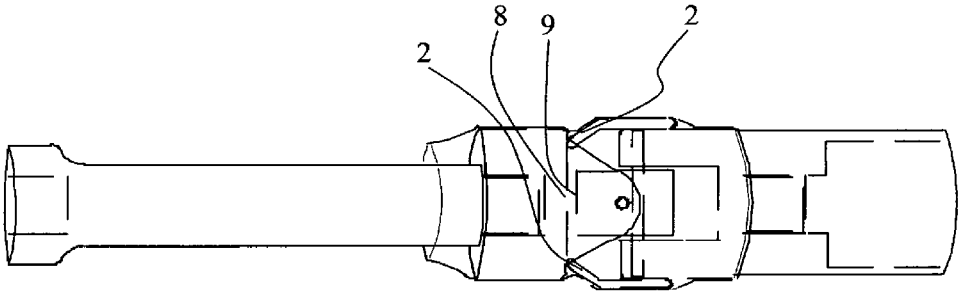

FIG. 1 present view of sleeve and universal joint.
FIG. 2 another view of the present sleeve.
FIG. 3 section of flex stop and location.
FIG. 4 another view of present sleeve.

Figure 5:
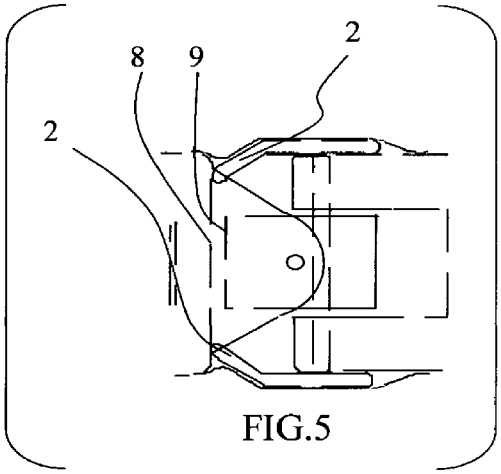
Figure 6:
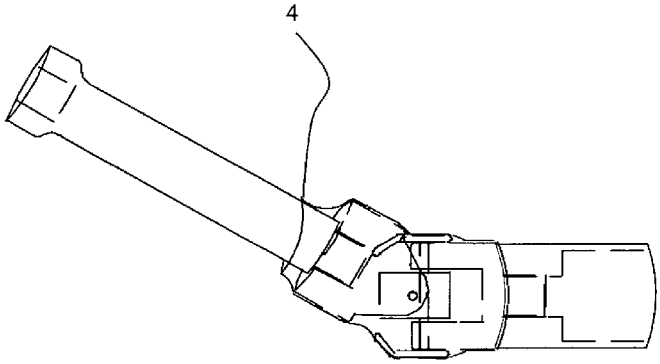
Figure 7:
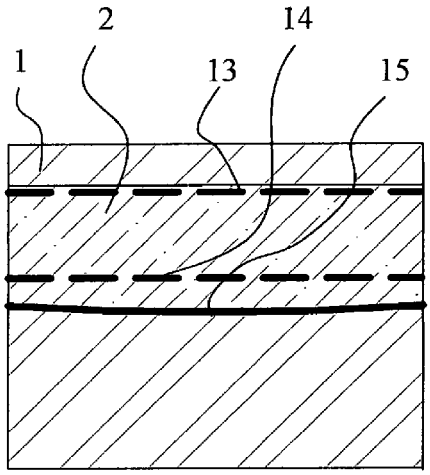
Figure 8:
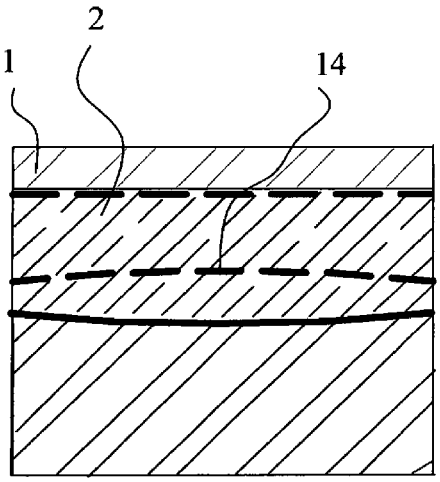
Figure 9:
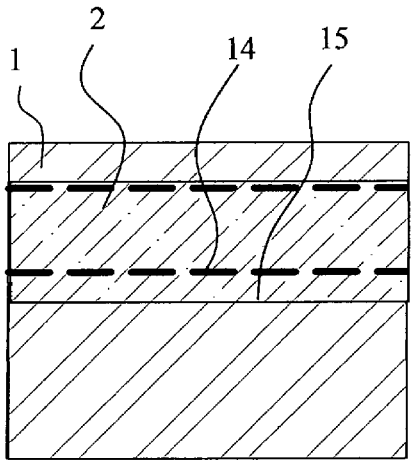
Figure 10:
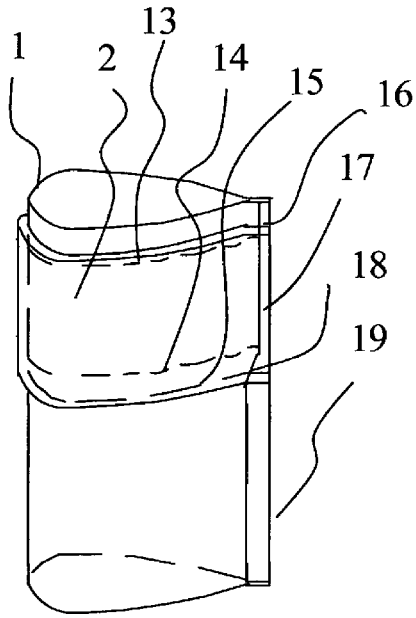
Figure 11:
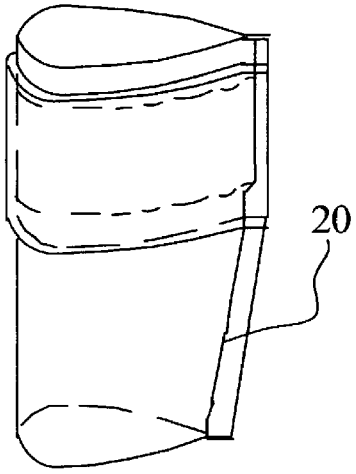
Figure 12:
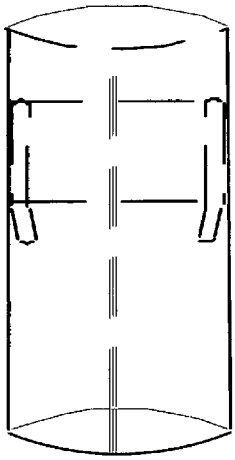
Figure 13:
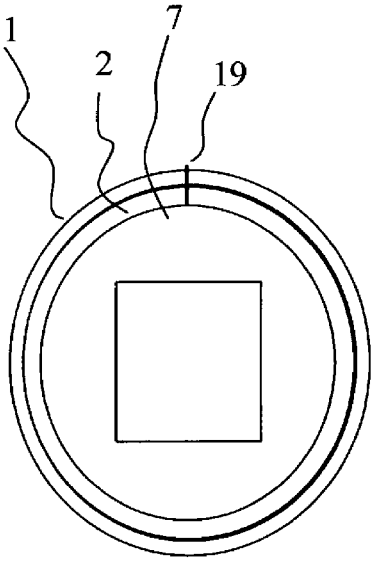
Figure 14:
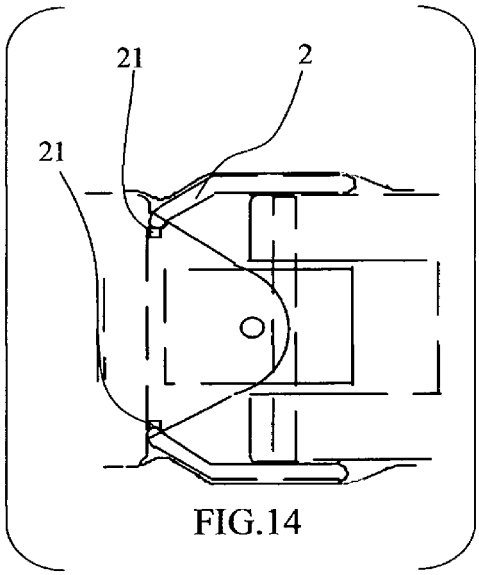
Figure 15:
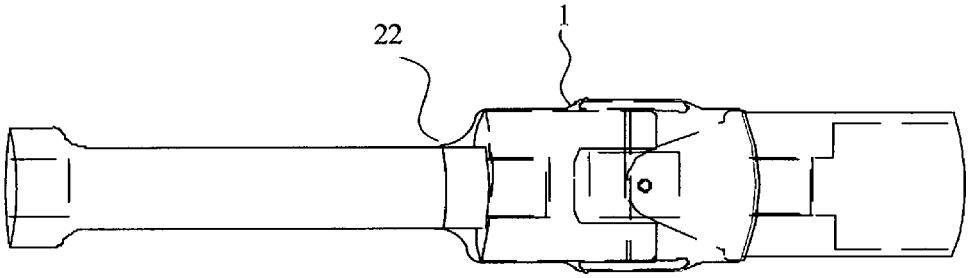
Figure 16:
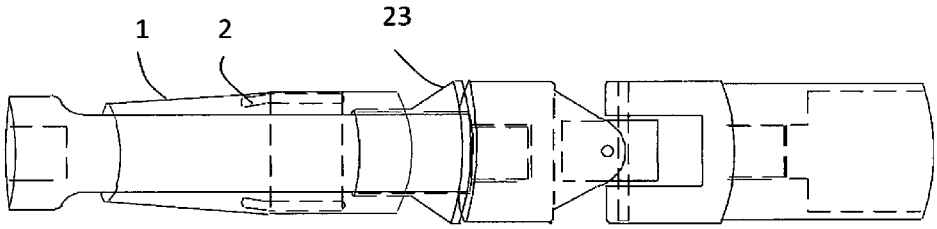

FIG. 5 sleeve and universal joint.
FIG. 6 another view with joint flexing.
FIGS. 7-9 optional attachments of the outer and inner layers of present sleeve.
FIG. 10 inner and outer layers forming an attachment of rounding in a inverted loop.
FIG. 11 showing an angled seam of inverted loop.
FIG. 12 shows present sleeve in form of a loop.
FIG. 13 plain view sleeve over joint illustrating the seam.
FIG. 14 detailed view flex stop.
FIG. 15 an assembled view sleeve on a joint.
FIG. 16 illustrates the installment process with an optional installation adapter.

LISTING OF THE REFERENCE CHARACTERS

1. outer layer; 2. inner layer; 3. forward end of outer layer; 4. trailing end of outer layer; 5. female end of universal joint; 6. trailing end of female end of universal joint; 7. forward end of universal joint; 8. edge of channel of female end; 8*a*. bottom of the channel female end; 9. trailing edge of the pivoting part assembly; 10. universal joints pivot pin; 11. Extension; 12. Socket; 13. top attachment inner to outer layer; 14. bottom attachment inner to outer layer; 15. the distal end of inner sleeve; 16. top of outer layer to outer layer sleeve location attachment; 17. outer layer to outer and inner layers to inner layer attachment; 18. adjustment from outer layer to outer layer and inner layer to inner layer attachment; 19. Seam; 20. angled flex lock attachment; 21. solid stop; 22. outer layer trailing region; 23. optional installation adapter.

DETAILED DESCRIPTIONS

A supplement support system sleeve FIG. 12 for a universal joint or swivel as drawn in FIG. 1. as shown in FIG. 1, the female end of universal joint 5, edge of channel of female end 8, trailing edge of the pivoting part assembly 9, universal joints pivoting pin 10 and forward end of universal joint 7 describe a typical universal joint designed mechanically to flex at degree angles and rotate within those degrees of angles. Sleeve made of but not limited to flexible materials, having a length and width as shown in FIGS. 7-9 that takes the shape of a sleeve when the width ends are attached FIG. 10 and FIG. 11. When inverted, FIG. 12 shows present sleeve in form of a loop has an outer dimensional distance and an inner dimensional distance as shown in FIG. 7 referencing shows outer layer 1 to inner layer 2. FIG. 13 shows inner layer 2 consisting of an outer dimensional distance and an inner dimensional distance. FIG. 5 shows a flex retention curve distance of inner layer 2. With the uniqueness of a supplement support system sleeve installed, with FIG. 1 showing covering the universal joint. whereas a system provides a flex lock described as a flex stop shown in FIG. 3 shows inner layer 2 to shows edge of channel of female end 8 also show in FIG. 5 as showing inner layer 2 showing the dimensional values to conform to FIG. 3 shows edge of channel of female end 8. whereas the flex stop goes from the trailing end of the universal joint to the edge of the universal joint manufacture design bridging the outer diameter as the designed of a universal requires removal of material center plus or minus of its diameter leaving a channel that provides a edge FIG. 1 shows edge of channel of female end 8 from the diameter to the outer radius. While installing and when the flex stop reaches the edge of channel of female end 8 as described, it conforms within its flex to the edge and seats inner layer 2 by the predetermined adjustment of flex that can be adjusted by setting the angle of the angled flex lock attachment 20. FIG. 10 shows the adjustment from outer to outer and inner to inner attachment 18 that retract movement from reduction of size to the trailing end of female end 6 of universal joint and the location plus or minus of the flex stop edge. FIG. 3 shows edge of channel of female end 8 is the flex adjustment described in FIG. 2 between inner layer 2 and trailing end of female end of universal joint 6 and continuing to the stretch reduction. FIG. 1 shows trailing end of outer layer 4 were the stretch would round the trailing end of the universal joint developing a pull to seat the flex stop on the edge of channel of female end 8 in shown FIG. 3. Also reference FIG. 16 for none scaled visual size to stretch when installed. Describing the universal joint as universal or swivel as a common name. The sleeve designed so that the majority of users can install without additional applicator other then the tool parts show in FIG. 1, showing extension 11 and socket 12 not limited to the use of all parts. Reference FIG. 16 shows optional installation adapter 23. By means of rotating back and forth while in a forward motion towards the most forward diameter end of the universal joint FIG. 1 shows forward end 3 of outer layer 1 not to include the mating part and the socket described in FIG. 1, Staying on known smooth surfaces of the universal joint per application and not limited to. Removable to clean the tools with the supplement support system sleeve machine washable with just the reversal of installing. Not limited to surfaces or other Universal Joints.

Further designed to restraints that would require an applicator to make easier to install. Example FIG. 16 shows optional installation adapter 23 a tub that fits over the mating part know as an extension 11 that the outside diameter would taper up to the size of the universal. Reference FIG. 16 shows optional installation adapter 23 as to a travel taper fit up to and on and continuing the installation process.

Further not limited to size and or shape within the range of a workable product within the description and claims. Extension being a verity of different sizes commonly ¼. ⅜. ½ and so on.

A supplement support system sleeve assisting by maintaining a level of flexibility, improving the positioning, stability with a universal joint or called a swivel, during loosening or tightening mechanical fasteners or adjustments. Most commonly known to be used with the tool known as a ratchet and its set, with the universal joint or swivel being a part of the set or an optional tool part. The universal joint or swivel was designed to give flexibility too hard to get to locations. I as an inventor and business describe the uniqueness of the design system that maintains the universal joint or swivel design with minimal limitation to its design movements while installed on and as well appearance and cleaning value of smooth surfaces.

Supplement support system sleeve is a two part system of flexible materials, as in a rubber base, woven or breaded base flexible and or containing flexible properties and not limited to a percentage of the different properties forming the material to be used.

It takes on a percentage of different ways to make or manufacture. The two parts play a unique part as in placement of the two parts together, a balance of tension to the material type size to tension strength to cost to perform it task as to our standards. Currently testing the restraint of staying on to a predetermined time while rotating the universal joint in its design degree circler rotation within a range of 35 to 40 average degrees for an acceptable level of retention. But not limited to material that requires a breaking in to conform to its potential of retention as to material stiffness and ware.

As to demoing the sleeve over a period of eight to ten hours the lighter material we use as supplement support system sleeve is good for conforming as to the design of staying on a smooth surface and holds a fair amount of its original retention after installing and uninstalling with constant rotations. Whereas the heavier material needs some breaking in before it conforms to the potential of the design and performance.

Material. Currently using is a percentage of polyester, rubber, polyester fiber silk, emulsion silk, "non-roll elastic", braided elastic, heat temperature resistant material or additives and other but not limited to any other material that doesn't restrict the tool part design values per described and of level of percentage of increased retention value.

Showing in FIG. 3 is the flexing of the inner sleeve 2 against the bottom 8*a* of the edge of channel 8 of the female end of the joint, as example but not limited to a mixture of materials on the market and to be manufacture as described above, wherein pliable or rigidity of the distal end of the inner sleeve is to conform to a clearance of the edge of the channel and the inner sleeve. Means to flexible also described above as were a more durable material can be applied as in woven and other or as shown in FIG. 14, flexible stop 21. The flexible stop being a solid material flex stop and wherein the dimensions of the solid material are of the limits to effectively engage in the locations shown in FIG. 5, i.e., the channel of the joint and described above.

System of invention design as two part designs as shown in FIG. 1, which shows the conforming of the supplement support system sleeve to the universal joint/swivel. FIG. 1 shows outer layer 1 and within the inner that of a flex stop of inner layer 2 consisting of an outer dimensional distance and an inner dimensional distance conforms as to flexible size of the sleeve to the larger size of the universal joint/swivel. Whereas a predetermined distance, length, width and thickness to a predetermined material strength. FIG. 1 shows outer layer 1 and inner layer 2 supplement support system sleeve covering the universal joint/swivel within the limitation of the movement to its design to house the universal joint parts by their outer dimensions. FIG. 1 shows female end of universal joint 5 to forward end of universal joint 7 combining the two flexible parts. FIG. 1 shows outer layer 1 and shows inner layer 2 as a ridged sleeve with adequate tension to the dimension and conforming to the design of the parts and shapes given with flexible material system design to hold the universal joint/swivel straighter to include attached component or components greater the weight to flex tension designed in the universal joint/swivel with minimal compromising the tools design and movement to operate as designed as to displacement tension through the tool parts dia. as described.

Current means of manufacture to achieve the system as shown in FIG. 10, i.e., inner and outer layers forming an attachment of rounding in an inverted loop.

FIG. 10 showing outer layer 1, showing inner layer 2, attachments 13, 14, 15, 17, 18, location 16 and the seam 19 with FIG. 11 showing the angled attachment 20 of the inverted loop, as described above. FIG. 1 shows inner layer 2 consisting of an outer dimensional distance and an inner dimensional distance conforms as to flexible size of the supplement support system sleeve to the larger size of the universal joint/swivel. Attachment of the flex stop (described above) to the outer support sleeve outer layer 1. In FIG. 7 top attachment inner to outer layer 13, attachment is tight to the edge if not overlapping to outer layer 1. FIG. 7 also showing the distal end 15 of inner sleeve showing a curve as to referencing tension that is applied by stretching the material by means of stretching in length and the means to attach with down pressure as to stretch as attaching the material designed to from an inward of less resentence of a curve shape from the entirety of the material of inner layer 2 while attaching bottom attachment inner to outer layer 14 to the material edge of the distal end 15 of inner sleeve. With the distance of bottom attachment inner to outer layer 14 to the distal end 15 of inner sleeve developing a stop, to not less than one and two shoulders that was formed as the universal joint/swivel trailing end is milled as to from both sides of the part to attach a rectangle pivot point part with the pivot pin 10, FIG. 1 shows the pivot points of connections. FIG. 1 edge of channel of female end 8 to the clearance distance of trailing edge of the pivoting part assembly 9 conforming within the material retention curve to the inner. Note that this is a balance to tension to material and its use as shown in FIG. 9 the distal end of inner sleeve 15 straight not limited to, as degree of curve formed as to attachment pressure. FIG. 8 bottom attachment inner to outer layer 14 shows none limit of material adjustment to tension. FIG. 10 shows the seam 19 as the width ends are attached, top of outer layer to outer layer sleeve location attachment 16, outer layer to outer and inner layers to inner layer attachment 17, adjustment from outer layer to outer layer and inner layer to inner layer attachment 18, the angled flex stop adjustment 20 not limited to one adjustment and the continuing of the attachment. FIG. 11 flex lock attachment adjustment 20, providing the flex stop pull to seat as described above. The angled adjustment 20 not limited to straight.

As the manufacturing shows in FIG. 10 then inverted FIG. 12 to the finished product, the angel of attachment to a smaller dia. distance. FIG. 11 flex lock attachment adjustment 20 but not limited to a straight attachment down from that point as to from a greater retention to the dia. displayed with the female end 6 of the universal joint/swivel and not limited to. FIG. 1 trailing end of outer layer 4 insuring that backward direction to the stop would be use either in use in an upward manner or in a downward manner. The trailing end shown in FIG. 1, trailing end of outer layer 4, has clearance to the extension 11. During rotation the extension flexes the Sleeve forward while at larger degree of rotation inserting greater level of compensating the force from the universal joint/swivel to the pull that would also be present without clearance to balance the difference of material leverage.

The trailing region 22 is shown in a tight conforming. Although this reduces the leverage advantage it is also an option of to clamp with a more fixed installing.

As in a more fixed and higher cost as well as limited to new design in the universal joint itself one snap ring grove in the male end of FIG. 1 No. 7 to a snap ring of flexible incorporated in to the Sleeve at a predetermined location to comply with the snap ring grove. Not limited to current manufacturing technology and processes.

As to the descriptions above, that the universal joint sleeve is not limited to other manufacturing means already being done to limiting seems and or manufactured as one part or process.

This description is based on the results of making several hundred if not over five hundred with improvement and older visions taken out of the sales. Going out to the markets and demoing and selling at a sale rate of greater than one hundred sold within the few show attended. It is a product that requires a good share of demonstration for awareness. After the demonstration it is more in the follow day that greater sales are made and only enhanced when other that have purchased sharing they acceptance.

We currently have 4 retail locations and one inquire public location. As well as through our web-site and links to other market sites offing our product for sale.

Limitations: Cost is a factor and as an inventor we have described the design as to cost and workability as to hand-made with equipment we have. It is made from ware item material and subject to stretching, abrasions, grease, oil and other mechanical substances and surroundings. Although the design has built in positioning to better hold it in place from one use to the other. It is still subject to sliding out of positioning most commonly do to slippery substances on the most commonly smooth surface of the tool part know as a universal or swivel. My personal use over several uses, this draw back does not seem to be a large disadvantage as it is easy to reinstall and later clean or clean at the time. We have machine washed and dried one that I personally used several times. Other than a wear look it conformed very close to its original installation of the tool part known as the universal or called a swivel that was used.

Skill level. Many years as a mechanical tinkering, maintenance, machinist, inventor with the use of tooling described in relation to the device.

I claim:

1. A flexible sleeve in combination with a universal joint comprising:

a universal joint comprising a forward end, a trilling end and a pivoting portion positioned between said ends, the pivoting portion forming a channel having a bottom surface;

a flexible sleeve comprising:

an outer layer having a length defining a first edge and a second edge;

an inner layer coupled to the outer layer between said first edge and said second edge, the layers together forming a flexible tube completely covering the universal joint, wherein said front end and said rear end of the outer layer extend beyond said forward end and said trailing end of the universal joint with the inner layer covering the pivoting portion of the universal joint;

the inner layer having a trailing end, the trailing end defining a relatively solid projection forming a flexible stop that engages the bottom surface of the channel;

wherein the flexible sleeve covering the universal joint allows pivoting of the universal joint while said engagement of the flexible stop and the channel prevents slippage.

2. The flexible sleeve of claim 1, wherein the sleeve comprises a material selected from the group consisting of polyester, rubber, polyester fiber silk, emulsion silk, "non-roll elastic", braided elastic, nylon, heat temperature resistant material or additives and combinations thereof.

3. The supplement support system sleeve of claim 1, wherein the layers are coupled with glue, sawing, weave or fusing.

* * * * *